US007730595B2

(12) United States Patent
De La Fuente et al.

(10) Patent No.: US 7,730,595 B2
(45) Date of Patent: Jun. 8, 2010

(54) INJECTION MOLDED MODULAR CASKET

(75) Inventors: Jose A. De La Fuente, Reforma 2600, Lomas De Chapultepec, Mexico DF 11000 (MX); Carlos A. Hoefken, Dallas, TX (US); Mike Don Harper, Fort Worth, TX (US)

(73) Assignee: Jose A. De La Fuente, Lomas De Chapultepec (MX)

( * ) Notice: Subject to any disclaimer, the term of this patent is extended or adjusted under 35 U.S.C. 154(b) by 586 days.

(21) Appl. No.: 11/297,864

(22) Filed: Dec. 9, 2005

(65) Prior Publication Data

US 2007/0130737 A1 Jun. 14, 2007

(51) Int. Cl.
*A61G 17/00* (2006.01)

(52) U.S. Cl. ..... 27/2; 27/7; 27/17; 27/27; 220/4.33; 220/682; 16/424

(58) Field of Classification Search ..... 27/2, 27/4, 7, 17, 27; 220/4.28, 691, 759, 4.33, 220/682, 683, 685, 692; 16/424
See application file for complete search history.

(56) References Cited

U.S. PATENT DOCUMENTS

| | | | | |
|---|---|---|---|---|
| 1,381,908 | A | 6/1921 | Downer | |
| 1,388,426 | A | 8/1921 | Greive | |
| 2,111,462 | A | 3/1938 | Simpson | |
| 2,916,797 | A | 12/1959 | McCombs | |
| 3,545,055 | A | 12/1970 | Pare | |
| 3,698,037 | A | 10/1972 | Johnson | |
| 3,823,447 | A | 7/1974 | Johnson | |
| 3,831,230 | A | 8/1974 | Rawlings | |
| 3,879,818 | A | 4/1975 | Rowland | |
| 3,981,054 | A | 9/1976 | Hull et al. | |
| 3,997,948 | A | 12/1976 | Hicks et al. | |
| 4,077,096 | A | 3/1978 | Christian | |
| 4,304,031 | A | 12/1981 | Semon et al. | |
| 4,320,562 | A | 3/1982 | Kelley | |
| 4,727,632 | A | 3/1988 | Yearsley | |
| 4,800,631 | A | 1/1989 | Pellmann | |
| 4,930,197 | A * | 6/1990 | McClive | 27/2 |
| 4,951,367 | A | 8/1990 | Wolfe | |
| 4,971,646 | A | 11/1990 | Schell et al. | |
| 5,113,786 | A | 5/1992 | Hayslip | |
| 5,121,529 | A | 6/1992 | McClure | |
| 5,199,589 | A * | 4/1993 | Noble | 220/7 |
| 5,201,102 | A | 4/1993 | McClure | |
| 5,222,281 | A | 6/1993 | Guerin | |
| 5,261,199 | A | 11/1993 | Schmidt | |
| 5,302,204 | A | 4/1994 | Hayslip | |

(Continued)

OTHER PUBLICATIONS

"Coffins to Bear Logos of Baseball Teams," Oct. 18, 2006, http://news.moneycentral.msn.com/provider/providerarticle.asp?Feed=AP&Date=20061018&ID=6115331&GT1=8618.

*Primary Examiner*—William L. Miller
(74) *Attorney, Agent, or Firm*—Colin P. Cahoon; Chad E. Walter; Carstens & Cahoon, LLP

(57) ABSTRACT

A modular casket that is easy to assemble and can be assembled with few or no tools is disclosed. The casket comprises a number of injection molded plastic pieces that can be snap-fit together. The casket is relatively compact and lightweight and is conducive to shipping and storage, yet has sufficient strength for its intended purpose.

16 Claims, 17 Drawing Sheets

U.S. PATENT DOCUMENTS 5,485,661 A 1/1996 McClure
5,495,648 A 3/1996 Rojdev et al.
5,519,923 A 5/1996 Rojdev et al.
5,568,677 A 10/1996 Tobin
5,606,785 A 3/1997 Shelberg et al.
5,619,785 A 4/1997 Tambussi
5,632,073 A 5/1997 Foye
5,680,682 A 10/1997 Watkins et al.
5,701,642 A 12/1997 Order
5,743,422 A * 4/1998 Hale ..... 220/4.33
5,762,785 A 6/1998 Garrigos Ruiz
5,966,786 A 10/1999 Bowling
5,974,640 A 11/1999 Vosahlik et al.
5,996,197 A 12/1999 Jurkovic
6,105,221 A 8/2000 Cox
6,154,939 A 12/2000 Woedl
6,223,404 B1 5/2001 Fant et al.
6,301,758 B1 10/2001 Biondo et al.
6,314,626 B1 11/2001 Becker
6,499,193 B1 12/2002 Robert
6,574,841 B1 6/2003 Vosahlik et al.
6,745,442 B2 6/2004 Biondo et al.
7,222,400 B2 * 5/2007 Leverett ..... 27/19
2007/0261219 A1 * 11/2007 Koch et al. ..... 27/4

* cited by examiner

INJECTION MOLDED MODULAR CASKET

The present invention generally relates to a modular casket or coffin.

BRIEF DESCRIPTION OF THE DRAWINGS

A more complete understanding of the method and apparatus of the present invention may be had by reference to the following detailed description when taken in conjunction with the accompanying drawings, wherein.

Figure 1:
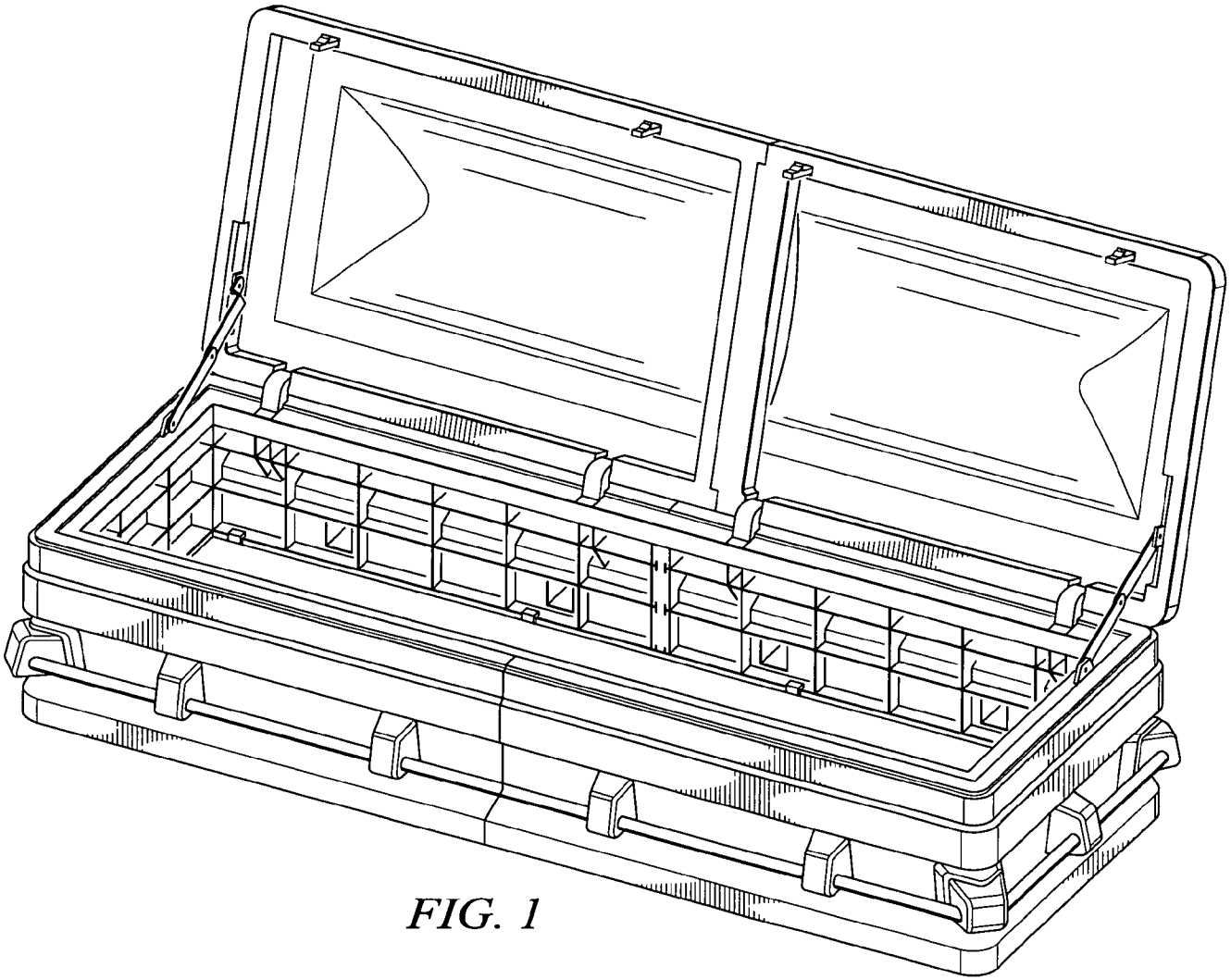
FIG. 1 is a top perspective view of the casket in accordance with one embodiment of the present invention.

Where used in the various figures of the drawing, the same numerals designate the same or similar parts. Furthermore, when the terms "top," "bottom," "first," "second," "upper," "lower," "height," "width," "length," "end," "side," "horizontal," "vertical," and similar terms are used herein, it should be understood that these terms have reference only to the structure shown in the drawing and are utilized only to facilitate describing the invention.

DETAILED DESCRIPTION

Figure 2:
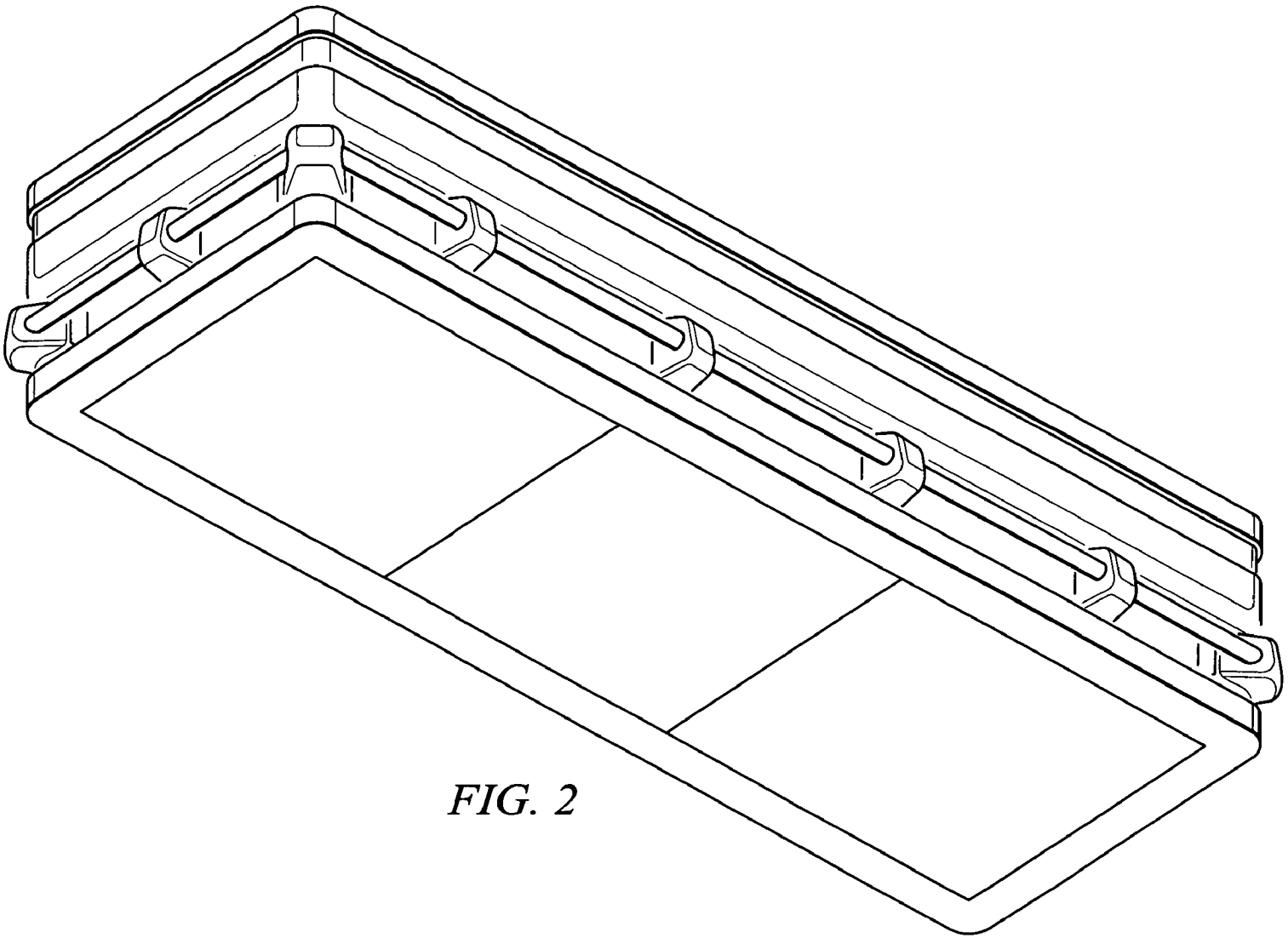
FIG. 2 is a bottom perspective view of the casket in accordance with one embodiment of the present invention.
Figure 3:
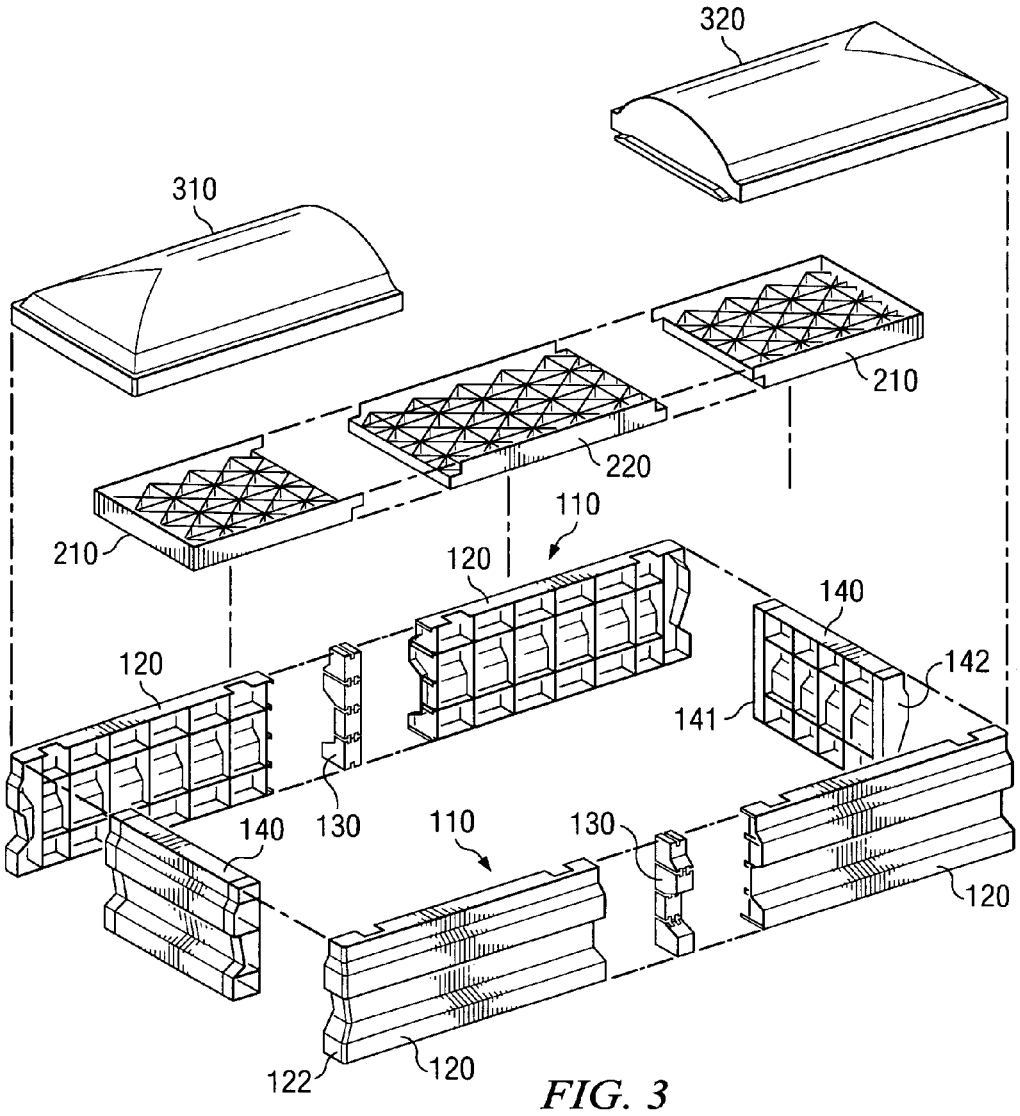
FIG. 3 is an overall exploded perspective view of the casket in accordance with one embodiment of the present invention.

FIG. 1 is a top perspective view of the casket in accordance with one embodiment of the present invention. As used herein, the term "casket" is synonymous with and meant to include the term "coffin." FIG. 2 is a bottom perspective view of the casket in accordance with one embodiment of the present invention. FIG. 3 is an overall exploded perspective view of the casket in accordance with one embodiment of the present invention. Referring to FIG. 3, the casket comprises a pair of opposed sidewalls 110. The same reference numbers are used to identify the same corresponding elements throughout all drawings unless otherwise noted. The sidewalls 110 comprise one or more side panels 120. In one embodiment, each sidewall 110 comprises a pair of side panels 120 slidably connected together by a wedge member 130. Each side panel 120 comprises a vertical side 122 designed to be slidably attached to a vertical end panel side 141 142. It should be pointed out that the "vertical" end panel sides 141 142 do not need to be vertical and such sides can be rounded. The term "vertical" is simply used to denote the side 141 142 of the end panel 140 that is attached to the side panel 120. Similarly, the vertical side 122 of the side panel 120 can be rounded or any other shape and is simply called "vertical" to denote the side 122 of the side panel 120 that is attached to the end panel 140. The base section can comprise one or more pieces. In one embodiment, the base section comprises two base ends 210 and a middle base portion 220. The base section can be attached to the opposed side panels 120 and/or said opposed end panels 140.

The lid can comprise one or more sections. In one embodiment, a first lid section 310 and a second lid section 320 can be attached to the sidewall 110. In one embodiment, the first lid section 310 is attached to a first side panel 120 and the second lid section 320 is attached to an adjacent second side panel 120.

The base section, side walls, end panels, and lid can comprise a plastic composition. Although the base section, side walls, end panels, and lid components and the hinge assembly can be formed from a variety of different materials using different manufacturing techniques, in the subject embodiment, they are injection molded from a suitable plastic containing fibers for reinforcement. Plastics that can be used include, but are not limited to ABS, polycarbonate, fiberglass, metals, and mixtures thereof. Any injection molded composition can be used. As used herein, an "injection molded composition" is defined as any material, resin or composite that can be injection molded. It should be further noted that different additives can be used for different injection molded parts. Strengthening ribs and other complex structures can be provided to make the components more rigid.

As shown in FIG. 3, each side panel 120 comprises one rounded edge near the end panel 140. Such illustration is just one example of how a rounded corner can be provided. In one embodiment (not shown), the end panel comprises one or more rounded corners. In one embodiment (not shown), a side panel comprises a rounded corner. Some consumers deem rounded corners to be desirable in caskets and caskets having rounded corners are more expensive to manufacture and are consequently more expensive in the marketplace. For example, the expenses of making a metal or steel casket with a rounded edge are significant because of the forming/stamping/pressing operation that is required to form the metal or steel material. Such forming equipment is expensive. Consequently, steel and metal caskets are typically cut to length and welded together to form square corners. However, caskets made of sheet metal are still labor intensive because of the welding and grinding that is required in putting the caskets together. Wood caskets more typically have rounded corners, but wood is relatively heavy, bulky, and expensive to ship. Both metal and wood caskets, if not assembled prior to shipment, are difficult to assemble at a point of distribution or use, unlike the present invention, which is easy to assemble for reasons discussed in more detail below.

Figure 4:
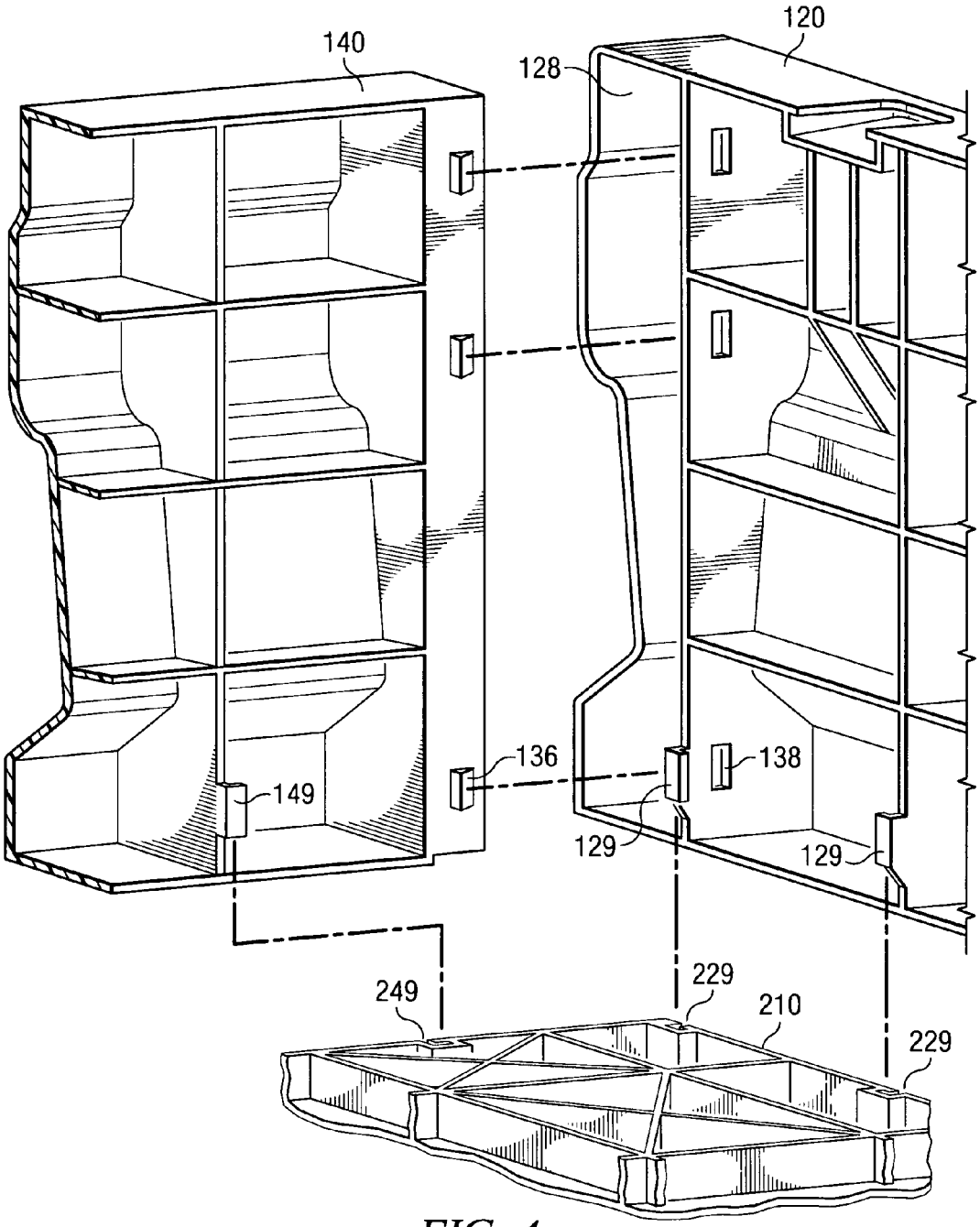
FIG. 4 is a partial cutaway detailed view depicting the connection between a side panel, an end panel, and a base section in accordance with one embodiment of the present invention.

FIG. 4 is a partial cutaway detailed view depicting the connection between a side panel 120, an end panel 140, and a base section 210 in accordance with one embodiment of the present invention. In the embodiment shown, the end panel 140 is sized to be slidably connected into the side panel 120 receiving cavity 128. As used herein the term "slidably connected" and the term "slidably attached" is defined by the attachment or connection of two pieces such that the pieces are pressure-fit together. "Pressure-fit," is a term known to those skilled in the art. The term can refer to a bond caused by mutual pressure acting on the contact surfaces between two parts in contact, wherein the two parts require no weld, screw, or nail connection. Thus, in one embodiment, the side panel 120 and receiving cavity 128 are sized to maximize the contact between the side panel 120 outer periphery and receiving cavity 128 inner periphery. In addition, a male member 136 on the end panel 140 is located so as to snap-fit into a female member 138 located on the side panel 120. Such members 136 138 help to further lock the two pieces together and secure the two pieces in place. Such members not only help hold the two pieces together, but they also further signal the assembler that the connection is complete. It should be pointed out that this specific connection is provided for purposes of illustration and not limitation. There can be any number of male and female pairs in any configuration. For example, in an embodiment not shown, similar male and female members are provided on the base section 210 and end panel 140 to further lock the end panel 140 and base section 210 together and/or signal the assembler that the connection is complete. In one embodiment not shown, similar male and female members are provided on the base section and side panel for similar reasons.

It should also be pointed out that the panels can be designed such that a side panel is sized to be slidably connected to an end panel receiving cavity (not shown). Such embodiment can occur if the end panel 140 is rounded and the side panel 120 is flat at the corner connection.

As shown in FIG. 4, in one embodiment, the base end 210 comprises L-shaped female side panel interlocking members 229 that can slidably connect to an L-shaped male side panel locking member 129. Similarly, the base end 210 comprises an L-shaped female end panel interlocking member 249 that can slidably connect to an L-shaped male end panel locking member 149. It should be pointed out that while the embodiment depicted and discussed with reference to FIG. 4 is directed towards L-shaped slots, any shape (tapered or untapered, L-shaped, T-shaped, etc.), number, and combination (male member on base and female on panel or female on panel and male on base) of interlocking-shaped members that can be used to slidably connect the base section 210 to the side panel 120 and/or end panel 140 does not depart from the spirit and scope of the present invention.

Figure 5A:
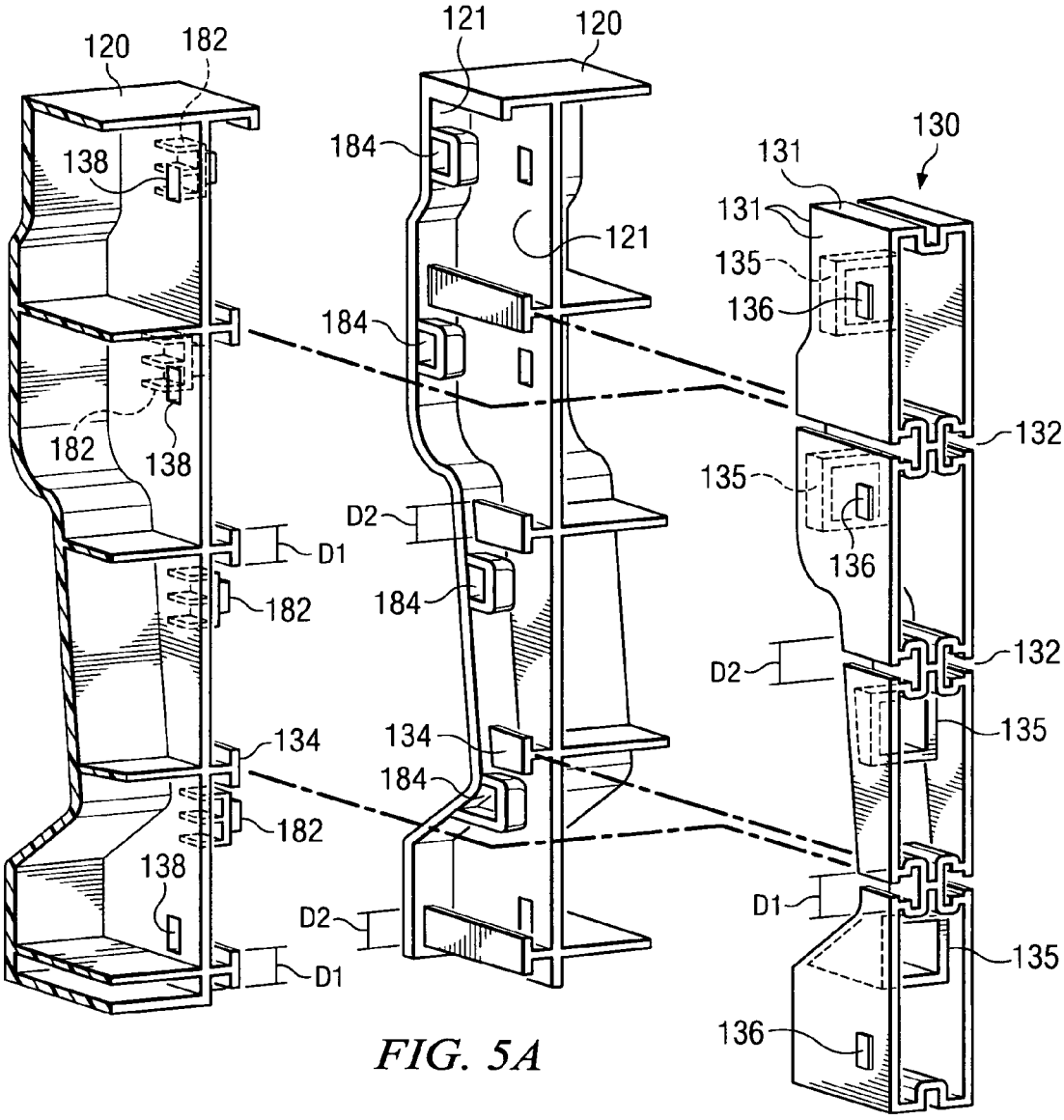
FIG. 5*a* is an exploded perspective side view depicting the connection of two side panels by a wedge member in accordance with one embodiment of the present invention.

FIG. 5*a* is an exploded perspective side view depicting the connection of two side panels 120 by a wedge member 130 in accordance with one embodiment of the present invention. Although the wedge member 130 shown depicts three pair of T-shaped female slots 132, the wedge member 130 can comprise any combination (number, shape, placement of male/female) of interlocking members. In one aspect, an interlocking member is a male member or a female member. Providing interlocking members as an integral part of the side panels, end panels, and base section allows the interlocking in as many places as is required without the need for a separate weld, nail, screw, nut, bolt, or adhesive. In one embodiment, the wedge member 130 comprises one or more female T-shaped slots. Further, the wedge member 130 can comprise one or more pairs of T-shaped male protrusions and/or one or more pairs of T-shaped female slots. Similarly, the side panels 120 can comprise one or more pairs of T-shaped male protrusions or female slots. In one embodiment the T-shaped female slots 132 and T-shaped male protrusions 134 disposed on the side panels 120 are tapered. Thus, in one embodiment, the male T-shaped protrusions 134 comprise a first distance D1 at the inner portion of the side panel 120 and a second, larger distance D2 at the outer portion of the side panel 120. Similarly, in one embodiment, the female T-shaped slots 132 comprise a first distance D1 at the inner portion of the female slot 132 and a second, larger distance D2 at the outer portion of the female slot 132. Of course, the tapering can be reversed resulting in a second, smaller distance D2. The male protrusions 134 and female T-shaped slots 132 slidably connect to adjoin the two side panels 120 in a sturdy fashion. In one embodiment, the wedge 130 and side panel are sized to maximize contact between the outer wedge periphery 131 and a portion of the inner side panel periphery 121. Male 136 and female 138 locking members can be provided to lock the wedge member 130 into place between the two side panels 120.

Although not necessary, in one embodiment, the first side panel 120 comprises a plurality of tapered or non-tapered integral alignment protrusions 182 that can be aligned with a plurality of corresponding tapered or non-tapered alignment slots 184 integral to a second side panel 120. A locking frame 135 on the wedge member 130 can be used to lock the alignment protrusions 182 and alignment slots 184 in place and help absorb any shock loads on the sidewall assembly.

The above-described configuration is beneficial for several reasons. First, the wedge member 130 permits side panels 120 to be fastened together with virtually no tools. At most, a rubber mallet may be required to force the wedge member 130 into place between the two side panels 120. Second, the configuration of the T-shaped protrusions and slots distributes any forces or tension placed on the wall joint over a larger area. Third, because the T-shaped protrusions and slots are oriented parallel to any normal forces exerted on the panels, e.g. forces that are perpendicular to the plane of the side panels, a sturdy connection can be made at the joint between the two side panels 120. Thus, the T-shaped protrusions and slots provide a resistance to forces normal to the side panel connection. Fourth, because the connection is intuitive to the user, the design facilitates assembly. Fifth, because no screws or nails are required, the connection can be made relatively quickly leading to more efficient casket assembly. Further, such connection is superior to nuts, bolts, screws, or nails because the fastening force is distributed over a larger surface area. Sixth, the connection can also be disassembled with few or no tools.

Figure 5B:
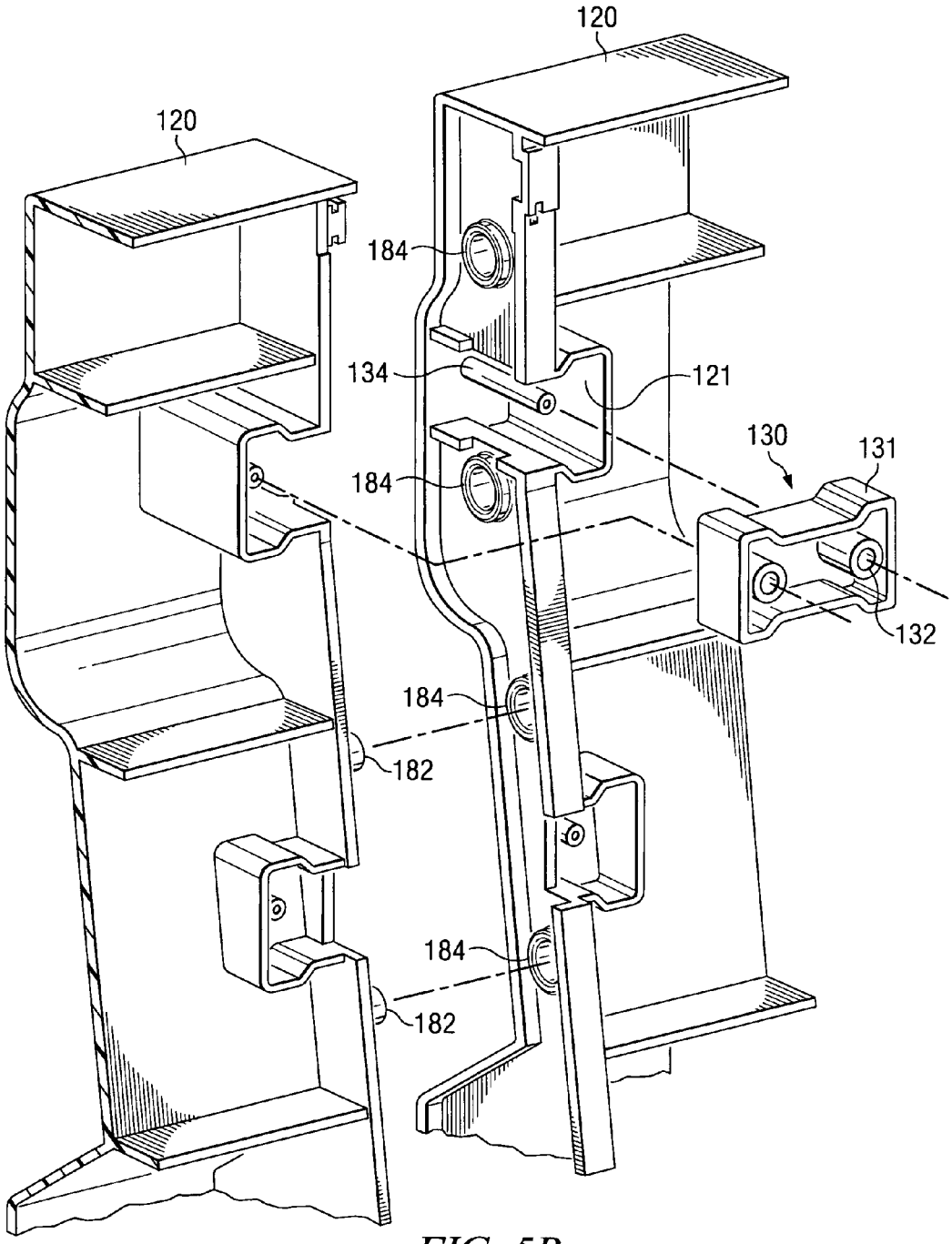
FIG. 5*b* is an exploded perspective side view depicting the connection of two side panels by a wedge member in accordance with an alternative embodiment of the present invention.

While several embodiments discussed above are directed towards T-shaped protrusions and slots, any type and number of tapered or non-tapered interlocking-shaped members can be used to slidably connect two side panels 120 together with a wedge member 130 without departing from the spirit and scope of the present invention. For example, FIG. 5*b* is an exploded perspective side view depicting the connection of two side panels 120 by a wedge member 130 in accordance with an alternative embodiment of the present invention. Referring to FIG. 5*b*, the I-shaped wedge member 130 comprises a hollow cylinder comprising a slot 132 in the center of the hollow cylinder. The side panel 120 comprises a smaller cylindrical protrusion 134 sized such that it can be snugly placed into the slot 132. In one embodiment, the wedge 130 and an integral portion of the inner side panel periphery 121 are sized to maximize contact between the outer wedge periphery 131 and a portion of the inner side panel periphery 121. The protrusion 134 and corresponding slot 132 can be tapered or non-tapered and may have male or female members (not shown) similar to those identified as numerals 136 and 138 in FIG. 4 to help the wedge member snap into place. Further, in one embodiment, another fastening means including but not limited to a wingnut with or without a washer (not shown), cotter pin or other device can be inserted through the protrusion 134 and slot 132.

Figure 5C:
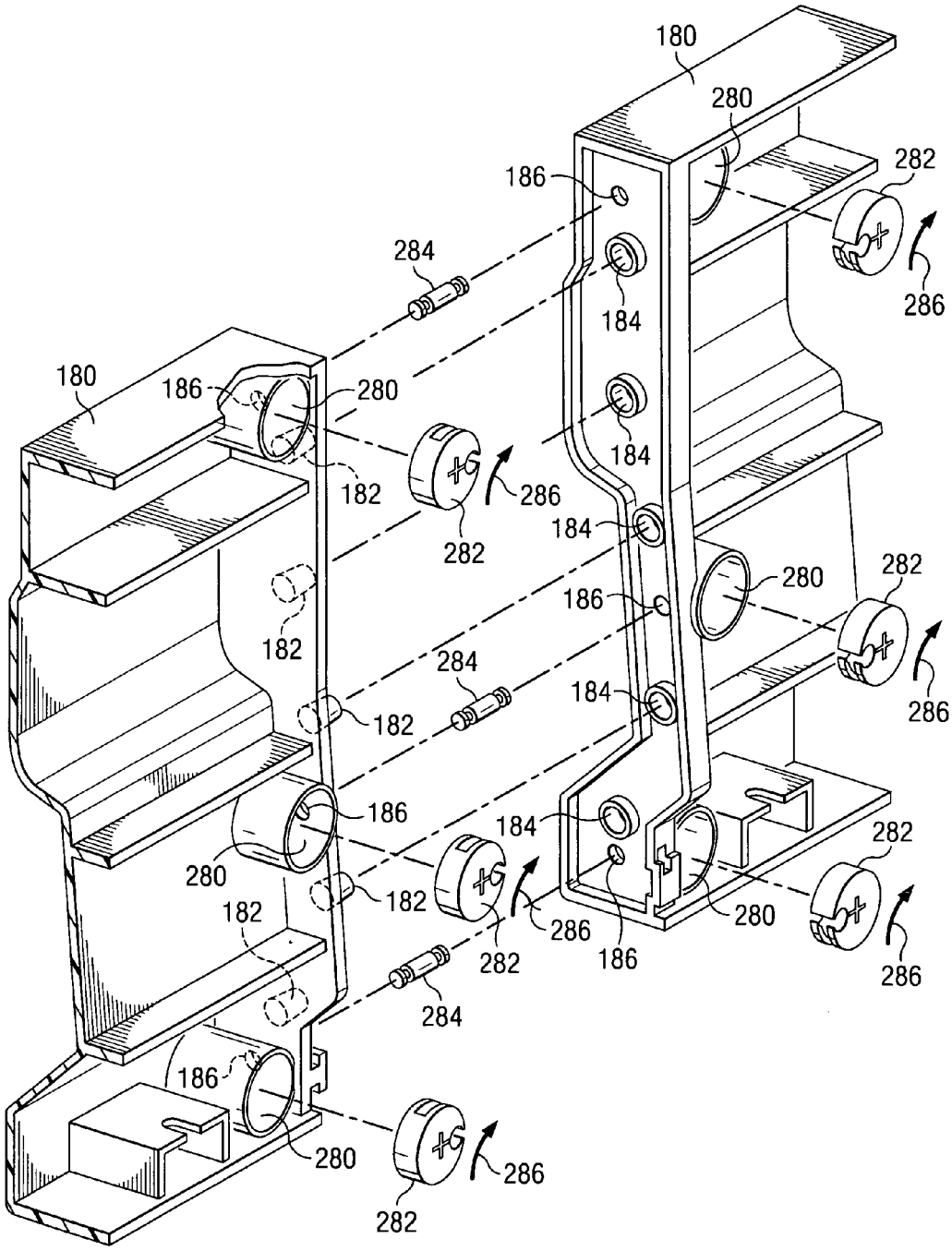
FIG. 5*c* is an exploded perspective side view depicting the connection of two side panels by a twist lock fastener in accordance with one embodiment of the present invention.

Further, other ways of fastening the side panels with minimal use of tools can also be provided without departing from the spirit and scope of the present invention. In one embodiment, casket components such as two or more side panels are pressure fit together. In one embodiment, two or more side panels are pressure fit together by a twist lock fastener. For example, FIG. 5*c* is an exploded perspective side view depicting the connection of two side panels 180 by a twist lock fastener in accordance with one embodiment of the present invention. As shown in FIG. 5*c*, each side panel 180 can be molded to include a plurality of cam receiving housings 280. An aperture 186 can be provided adjacent the housing 280 to permit placement of a dowel 284. A first side panel 180 can comprise a plurality of tapered or non-tapered alignment protrusions 182 that can be aligned with a plurality of corresponding tapered or non-tapered alignment slots 184 integral to a second side panel 180. The alignment slots 184 and alignment protrusions 182 can help to align the two side panels 180 during assembly. The first and second side panels 180 can then be pressure-fit and secured together by a twist lock fastener. In the embodiment shown, the twist lock fastener comprises two cams 282 and a dowel 284. The dowel 284 is placed into a housing 280 and through the aperture 186 such that the dowel 284 resides partially in a housing 280 of each side panel 180. A cam 282 can then be placed into each housing 280 over the dowel 284 and each cam 282 can then be turned in the direction of the arrow 286 to secure the side panels 180 together. Although the cam 282 can be configured such that it can be turned with a screwdriver as is depicted in FIG. 5*c*, the cam 282, in an embodiment not shown, can also be configured to have an extension similar to a wing nut that can be hand-tightened to help reduce the number of or eliminate all tools required for assembly. In one embodiment, a single cam can be used with a dowel designed for single cam fastening.

Figure 6B:
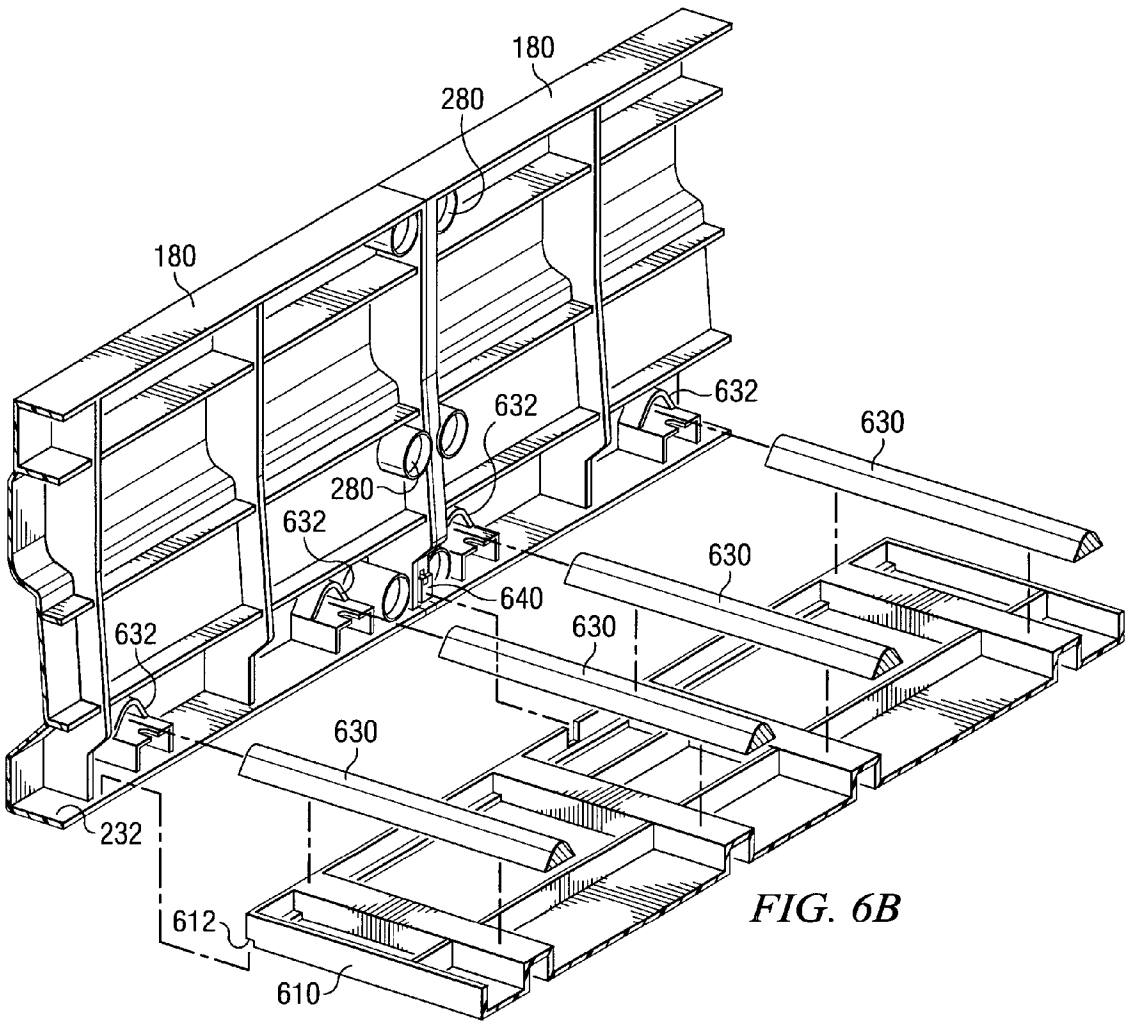
FIG. 6*b* is a perspective view depicting a base section in accordance with an alternative embodiment of the present invention.
Figure 6A:
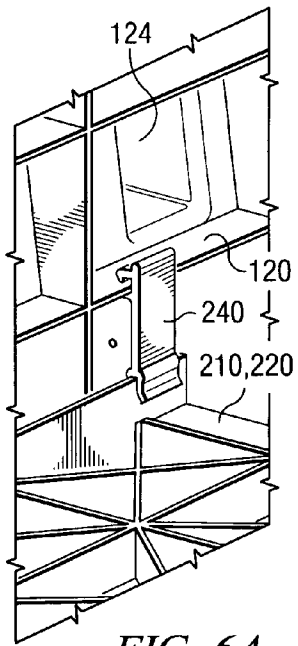
FIG. 6*a* is a perspective view showing how the base section can be further secured to a side panel in accordance with one embodiment of the present invention.

FIG. 6*a* is a perspective view showing how the base section can be further secured to a side panel in accordance with one embodiment of the present invention. As depicted in FIG. 4, the base section 210 slidably connects to the side panel 120 and the clip 240, as depicted in FIG. 6*a*, can be used merely add support and help secure the connection under heavier loads. One or more clips 240 can be used to further secure each side of a base end 210 and/or a middle base portion 220 to the side panel 120 and/or the end panel 140. In one embodiment, one or more clips 240 are used at or near joints between the base end 210 and the middle base portion 220. Such configuration is beneficial for several reasons.

First, the clips 240 permit the side panels 120 to be securely fastened to the base end 210 or middle base portion 220 with no tools. Second, because the connection is intuitive to the user, the design facilitates assembly. Third, because no screws or nails are required, the connection can be made relatively quickly leading to more efficient casket assembly.

In one embodiment, the clip 240 mouth is designed to be slightly smaller than the ribs inside a side panel 120 or end panel 140 (not shown) or the base end 210 and/or base portion 220. This enables the clip 240 to pressure-fit onto and retain the ribs of the side panel 120 and portion of the base end 210 and/or base portion 220 to better secure the connection between the side panel 120 and any base section 210 220. Also depicted in FIG. 6*a* is a side panel handrail receiving member 124 which is discussed in more detail below.

FIG. 6*b* is a perspective view depicting a base section in accordance with an alternative embodiment of the present invention. A portion 612 of the base section 610 is disposed on the side panel ledge 232. A stiffening bar 630, made of metal or plastic, can be placed into a housing 632 disposed near the side panel ledge 232. In one embodiment, the housing 632 is integral with the side panel 180. A joint protrusion 640 can be provided to help hold the base section 610 in the proper position during and after assembly.

Figure 7:
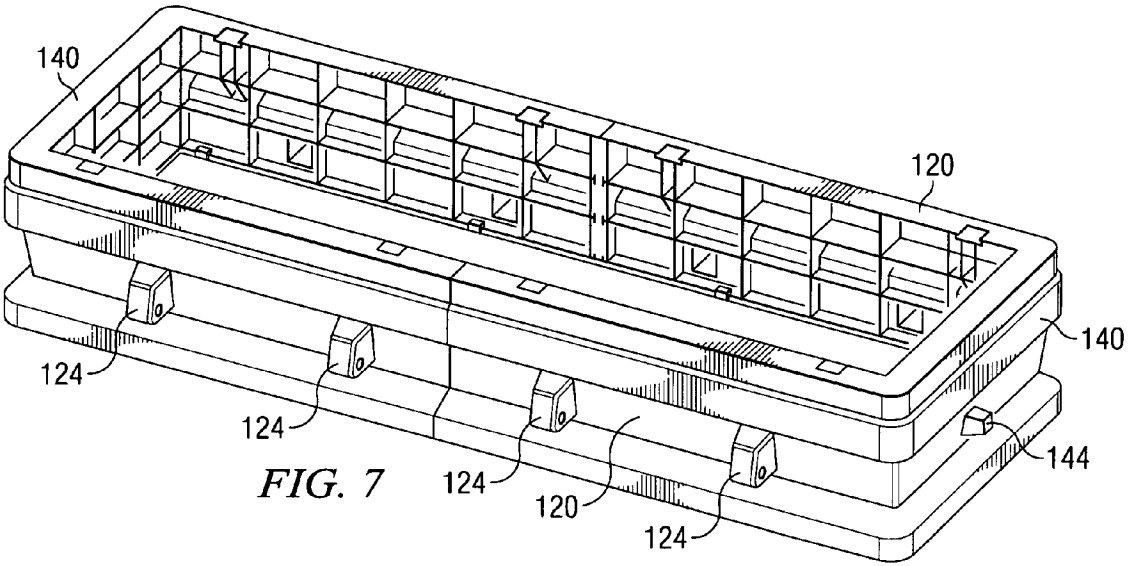
FIG. 7 is a perspective view of a partially constructed casket in accordance with one embodiment of the present invention.

FIG. 7 is a perspective view of a partially constructed casket in accordance with one embodiment of the present invention. In one embodiment, one or more side panel handrail receiving members 124 are formed integrally with each side panel 120. In an alternative embodiment (not shown), one or more handrail receiving members are formed integrally with a base section. Thus, in one embodiment, at least one side panel or base section further comprises one or more handrail receiving members 124 wherein the handrail receiving member is integral to the side panel or base section. One advantage of an integral handrail receiving member 124 is that forces imparted through the hole to the handrail receiving member 124 by a handrail are spread more evenly over a larger area than would occur if the handrail receiving member 124 were attached by some type of fastener. Consequently, an integral handrail receiving member 124 has greater strength and can withstand a heavier load that a non-integral, fastened handrail receiving member. Another advantage is that the hole in the handrail receiving member can be formed at the same time as the side panel or base section resulting in less assembly to the end-user.

Figure 8:
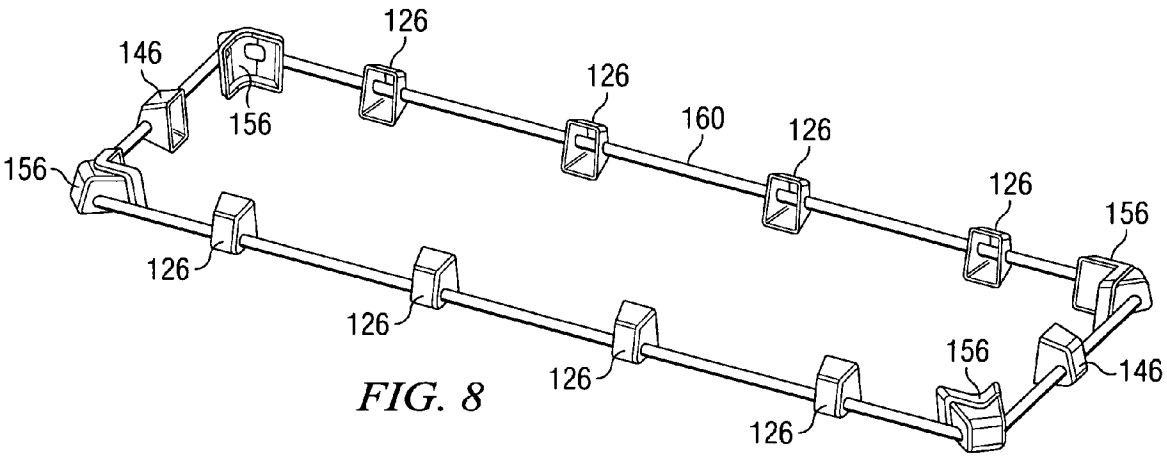
FIG. 8 is a perspective view depicting the pallbearer handrail in accordance with one embodiment of the present invention.

FIG. 8 is a perspective view depicting the pallbearer handrail 160 in accordance with one embodiment of the present invention. Referring to FIG. 7 and FIG. 8, the side panel handrail receiving members 124 each comprise a hole for insertion of the handrail 160. In one embodiment, the handrail 160 comprises four separate rails; two long handrails disposed through the handrail receiving members 124 and two shorter handrails adjacent the end panels 140. Once the casket in FIG. 7 has been constructed, decorative handrail covers 126 can be snap-fit over the side panel 120 handrail receiving members 124. The decorative handrail covers 126 146 156 can comprise any decorative design feature including a cross or other emblem. The long handrails can then be inserted through the holes in the receiving members 124. The shorter handrails can then be inserted through the decorative end panel covers 146 and through the four corner handrail covers 156. One advantage of such a configuration is that it permits attachment of a handrail without the use of tools. A coupling or corner union (not shown) inside the corner handrail covers 156 connects the shorter handrails to the longer handrails. Any of the decorative handrail covers 126 146 156 can be attached by any number of ways including a snap-fit connection, a fastener connection including a nut or bolt or screw, an adhesive such as double-sided tape, and/or can be held into place by the handrail 160 itself. In one embodiment, the handrail 160 comprises two separate rails adjacent the side panels 120.

Figure 9A:
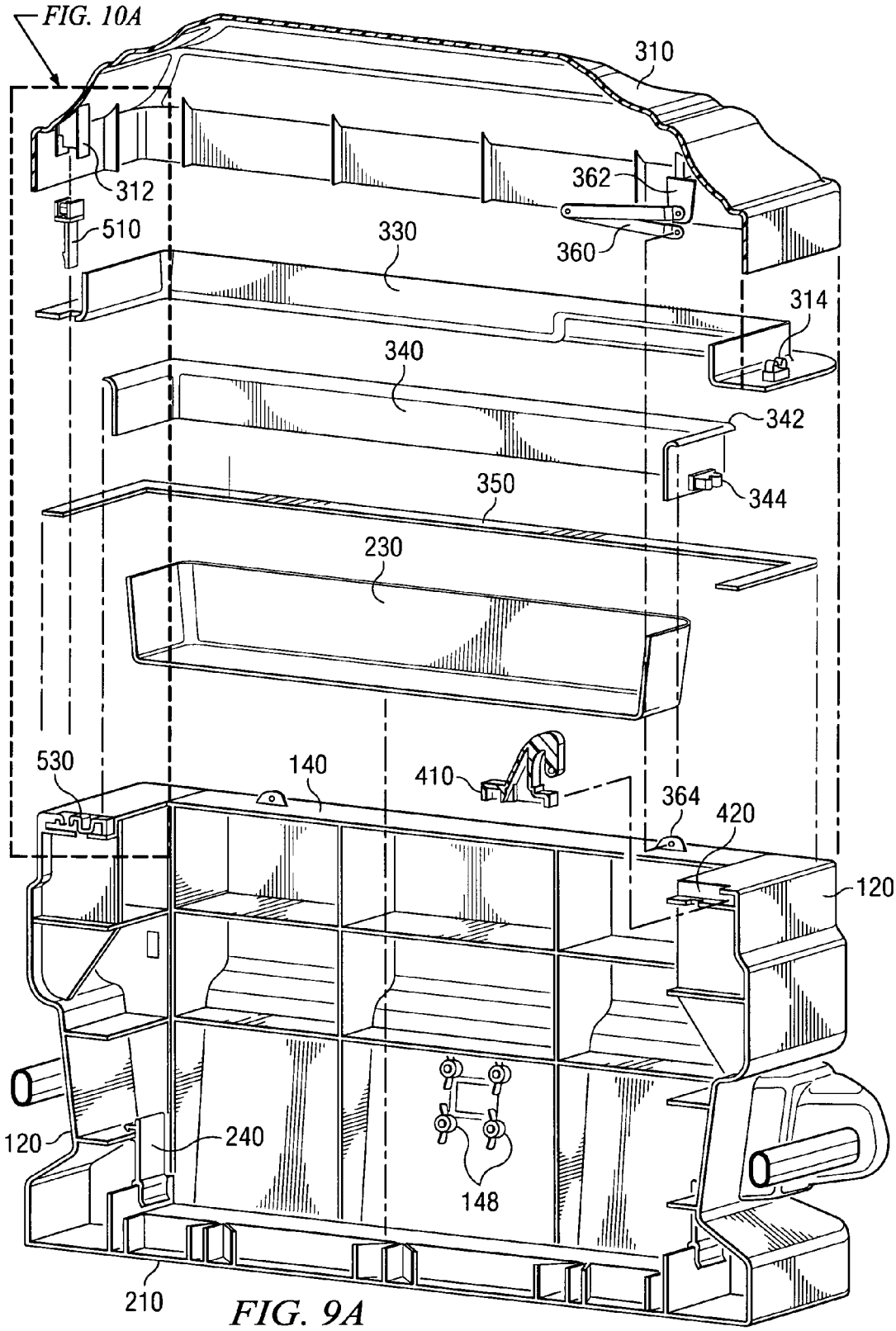
FIG. 9*a* is a partial cutaway exploded view of the inside of one end of the casket in accordance with one embodiment of the present invention.
Figure 9B:
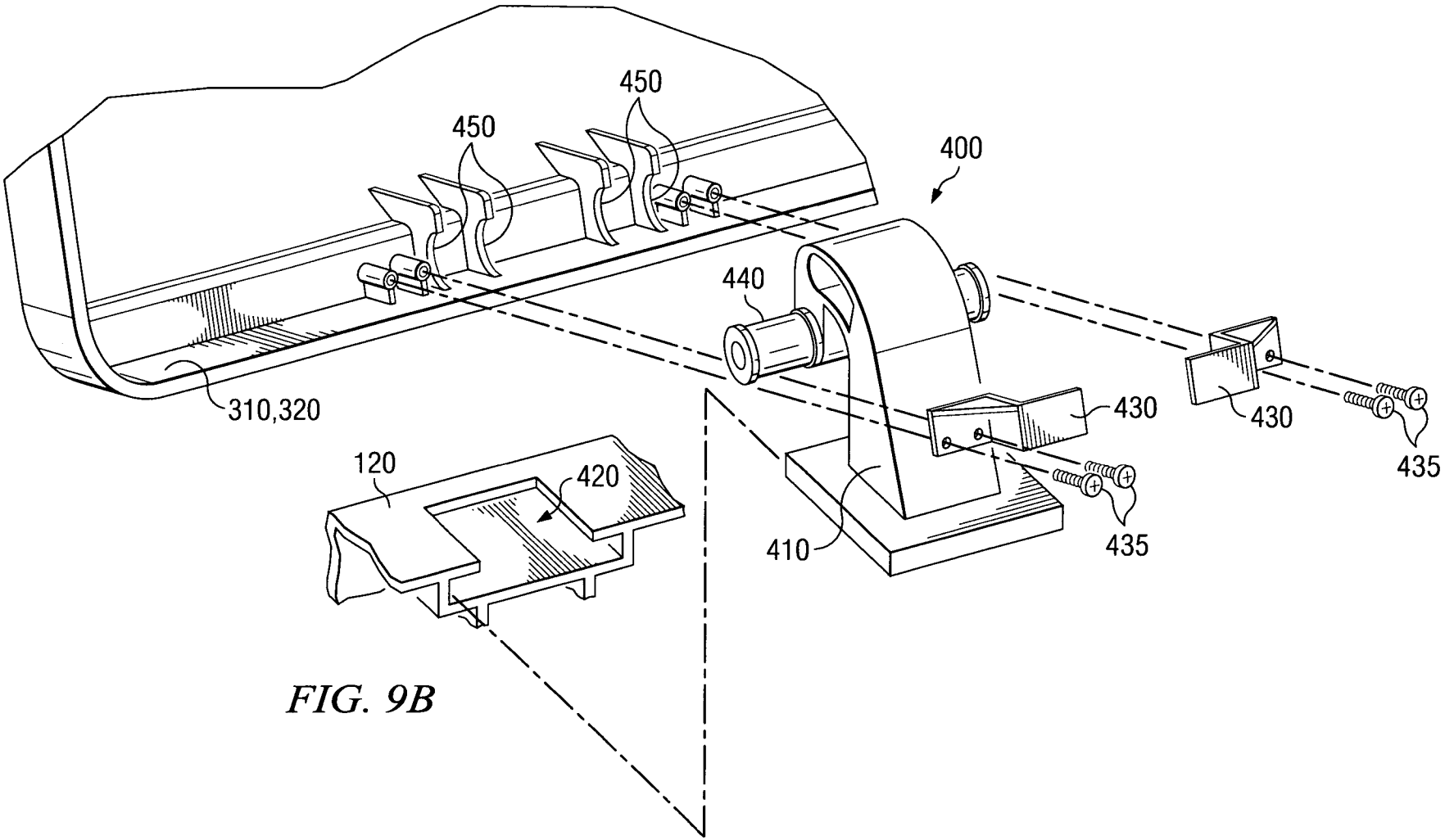
FIG. 9*b* is an exploded perspective view depicting the hinge assembly in accordance with one embodiment of the present invention.

FIG. 9*a* is a partial cutaway exploded view of the inside of one end of the casket in accordance with one embodiment of the present invention. FIG. 9*b* is an exploded perspective view depicting the hinge assembly in accordance with one embodiment of the present invention. Referring to FIGS. 9*a* and 9*b*, the hinge assembly 400 comprises a hinge base 410 slidably connected into a hinge slot 420, wherein the hinge slot 420 is located on the top portion of the side panel 120. Two pieces comprising a hinge pin 440 can be placed into a receiving hole in the hinge base 410 and press-fit together. In one embodiment, the entire hinge assembly 400 is made from an injection molded plastic. One or more hinge pin 440 receiving members 450 can be integral to the first lid section 310 and/or second lid section 320. In one embodiment, screws 435 can be used to attach a hinge bracket 430 to the lid 310 320. In one embodiment, only a screwdriver is needed to attach the hinge assembly 400 to the lid 310 320. Consequently, in one embodiment of the present invention, the casket can be assembled with minimal tools, the only tools potentially necessary being a screwdriver and a rubber mallet. It should also be pointed out that the screws 435 can be replaced with a screw having a configuration that can permit the hinge to be fastened to the lid 310 320 in a manner that requires no tools. For example, a pair of screws 435 having an extension similar to a wing nut that can be hand-tightened can be used. In one embodiment, such extension does not exceed the diameter of the head of the screw 435. In one embodiment, a cotter-pin type fastener is used. Thus, some embodiments of the present invention provide a modular casket that requires no tools for assembly.

Figure 9C:
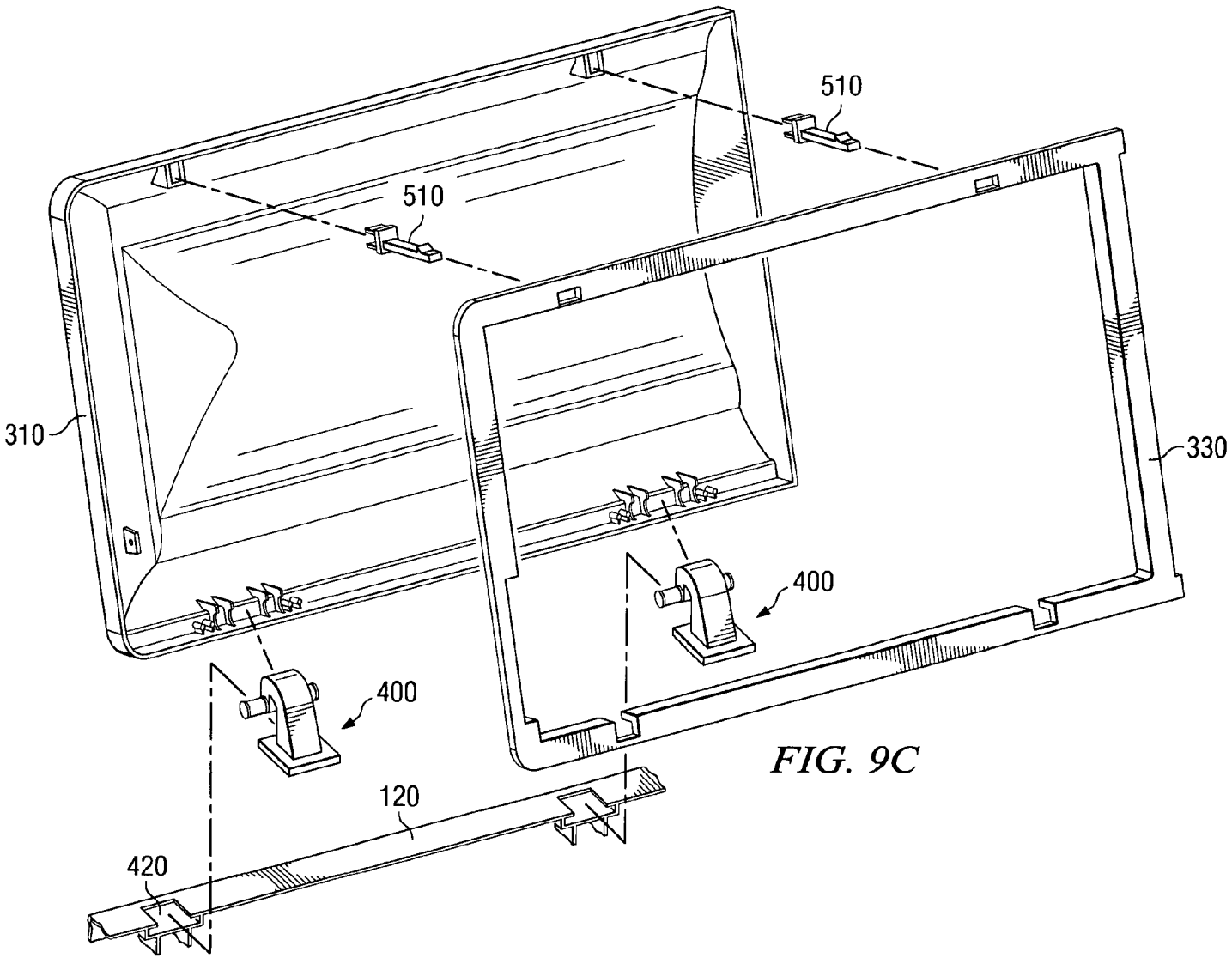
FIG. 9*c* is a partial exploded perspective view taken depicting the lid assembly in accordance with one embodiment of the present invention.

FIG. 9*c* is a partial exploded perspective view depicting the lid assembly in accordance with one embodiment of the present invention. Referring to FIGS. 9*a* and 9*c*, a lid frame 330 can be placed about the inner periphery of the lid 310. The lid frame 330 can be injection molded such that a plurality of metal heart-shaped clips 314 can be snap-fit onto the lid frame 330, as best shown by FIG. 9*a*. The mouth end of the metal clip 314 can engage a corresponding rib on the lid 310 to hold the lid frame 330 in place. Because the metal clip 314 comprises a sharp mouth surface, the mouth surface can grip an adjoining rib. A lid frame can similarly be joined to any other lid sections including a second lid section 320.

Figure 9D:
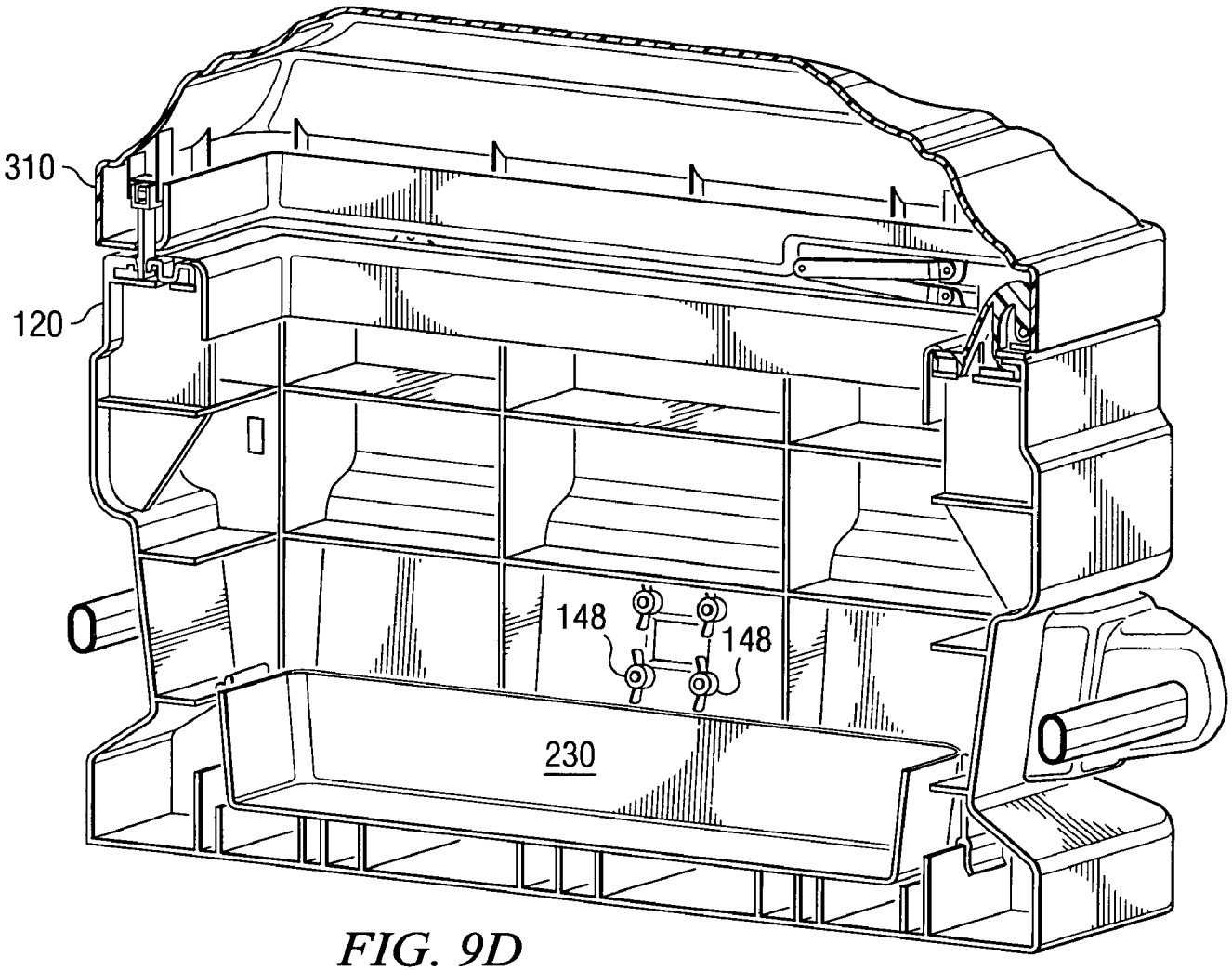
FIG. 9*d* is a partial cutaway view depicting the end of the casket from the inside in accordance with one embodiment of the present invention.

FIG. 9*d* is a partial cutaway view depicting the end of the casket from the inside in accordance with one embodiment of the present invention. Referring to FIGS. 9*a* and 9*d*, in one embodiment, the casket comprises a casket frame 340 and gasket 350 disposed about the outer, upper perimeter of the side panels 120 and end panels 140. The casket frame 340 can provide aesthetic features such as a lip 342. The casket frame 340 can be attached to the side panels 120 and end panels 140 by a plurality of metal clips 344 in the same manner that the lid frame is attached to the lid 310 as discussed above.

In one embodiment, a fabric covers the inside of the side panels 120 and end panels 140. The fabric can be attached to the upper side panels 120 and end panels 140 by the metal clips 344. In one embodiment, a pan 230 is placed in the bottom of the casket. A fabric material may or may not also cover the pan 230. In one embodiment an inflatable air mattress is also placed into the casket to provide the desired elevation of the body in an open casket or other ceremony. The gasket 350 can be attached by an adhesive. A simple arm assembly 360 can be attached to the lid locking arm mount 362 and the end panel locking arm mount 364 to prevent the lid from opening too widely. Each of these arm mounts 362 364 can be integrally injection molded with their respective pieces. Also shown in FIG. 9*d* are the wingnuts 148 used to fasten the decorative end panel handrail cover to the outside of the end panel 140.

Figure 10A:
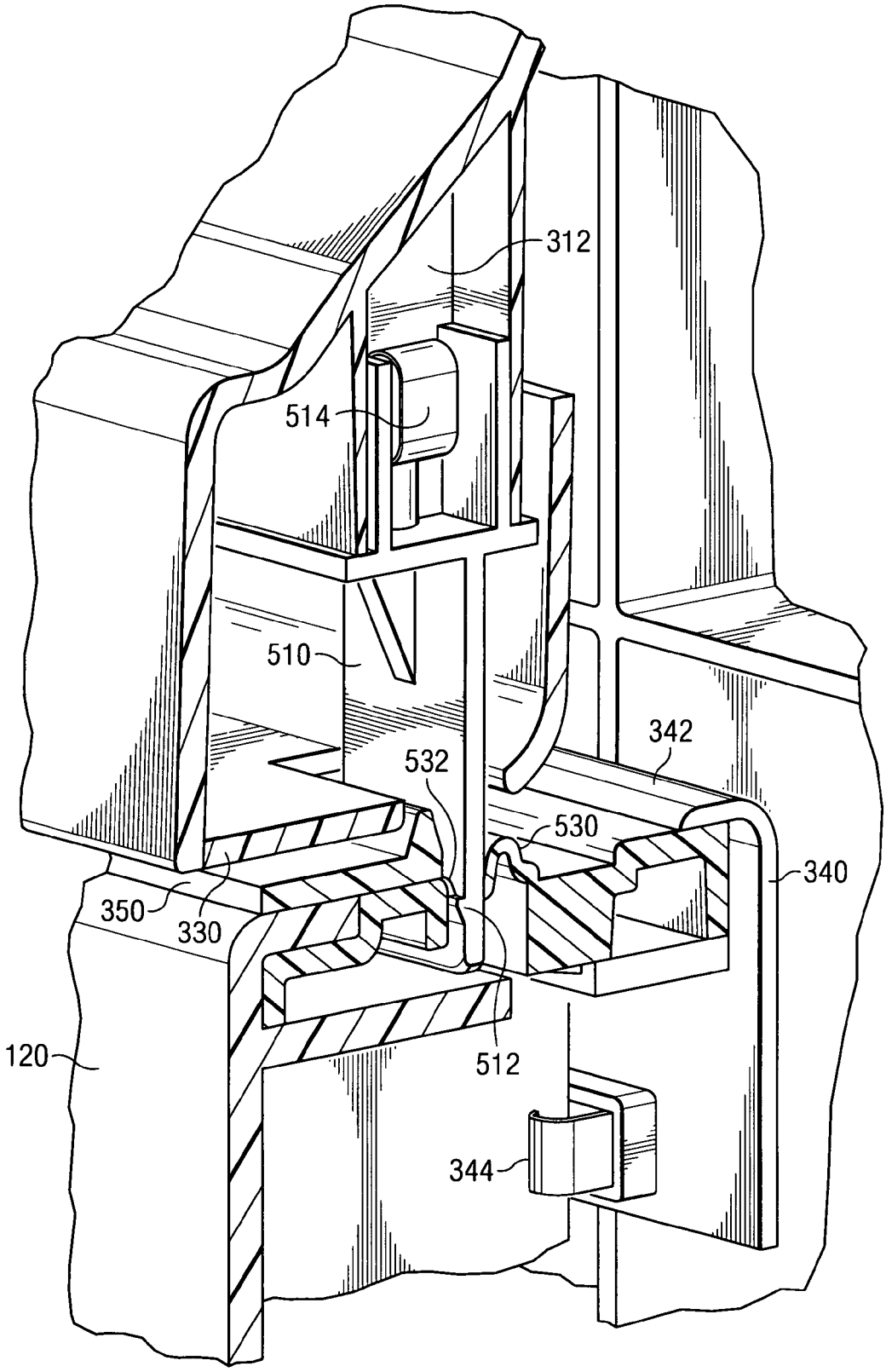
FIG. 10*a* is a partial cutaway view of the portion labeled FIG. 10A in FIG. 9*a* depicting the locking mechanism in accordance with one embodiment of the present invention.
Figure 10B:
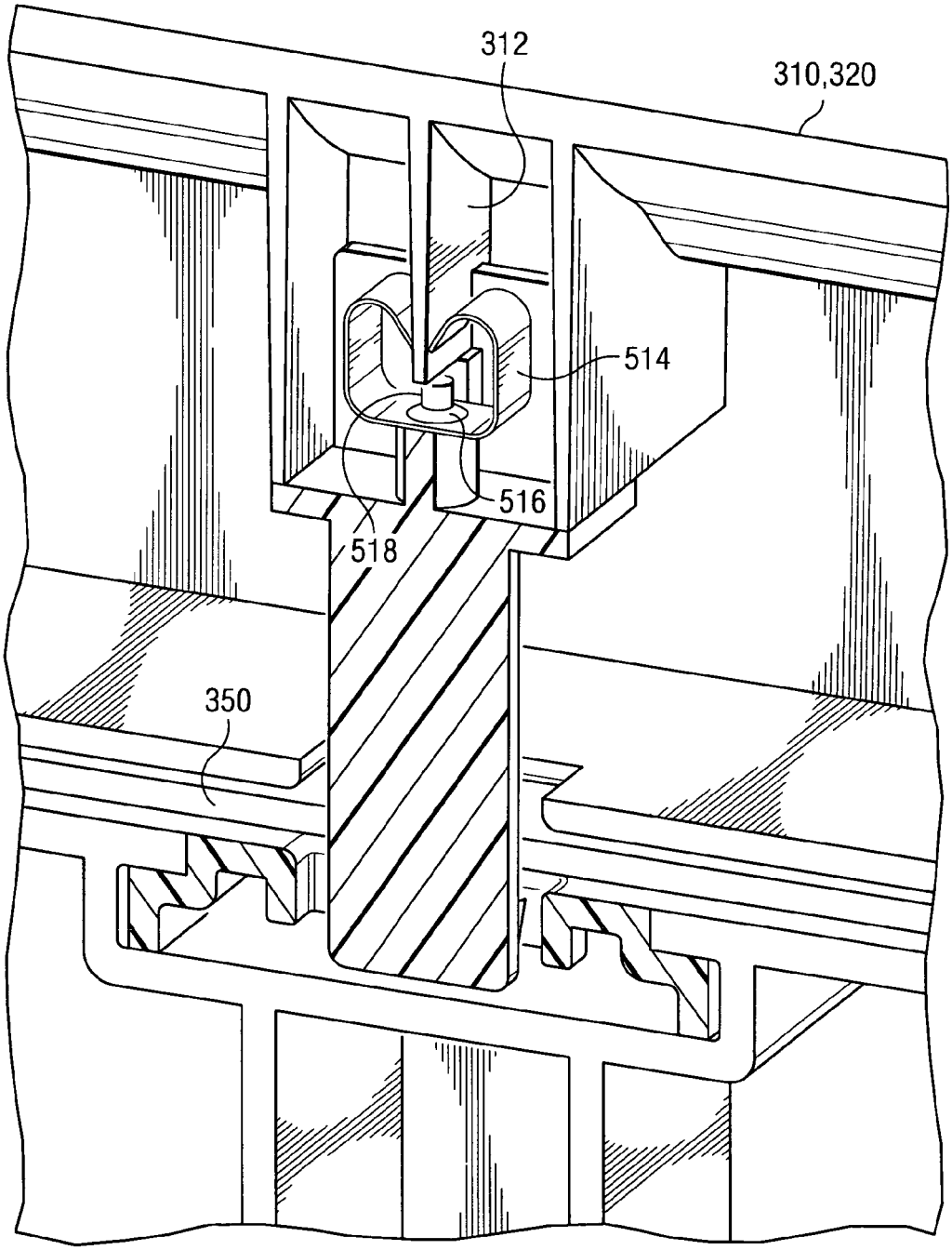
FIG. 10*b* is an alternative partial cutaway view depicting the locking mechanism depicted in FIG. 10*a*.

FIG. 10*a* is a partial cutaway view of the portion labeled FIG. 10A in FIG. 9*a* depicting the locking mechanism in accordance with one embodiment of the present invention. FIG. 10*b* is an alternative partial cutaway view depicting the locking mechanism depicted in FIG. 10*a*. Referring to FIGS. 10*a* and 10*b*, in one embodiment, a latch assembly comprises a clip 514, a male latch 510, and a female latch 530. In one embodiment, the clip 514 comprises a raised collar 516 that can be press fit around the cylindrical tip 518 integral to the latch 510. In one embodiment, the mouth of the clip 514 can then be press-fit onto a rib 312 integral to a lid section 310 320. A female latch 530 can be slidably attached to the top portion of the sidewall 120. A male latch ledge 512 mates with a female latch ledge 532 after insertion into the female latch 530. One advantage of such configuration is that no latches are visible on the outside of the casket. Thus, the latch is not fastened to an outer periphery of the side panel or lid.

To open, a rigid, flat card (e.g. a credit-card like object) can be placed between the lid frame 330 and the side panel 120 and can be used to push the male latch 510 inward to permit the lid 310 to open. In one embodiment a resilient, rubber-like L-shaped gasket 350 is about the upper perimeter of the side panel 120 and the credit card-like object can press a portion of the gasket 350 into the male latch 510 to permit the lid 310 to open.

One skilled in the art would recognize that such feature could be reversed and in one embodiment the female latch portion 530 is attached to the lid 310 320 and the male portion 510 extends from the side panel 120. Similarly, one skilled in the art would recognize that both the female latch 530 and male latch 510 can be attached to the lid 310 320 or the side panel 120 by a clip or by a pressure-fit mount. The present invention should therefore be construed to include all embodiments wherein male 510 or female latch 530 is attached to a lid 310 320, and wherein further said male latch 510 or said female latch 530 removably fastens the lid 310 320 to the side panel 120, wherein said latch assembly is snap-fit together. Another advantage of such configuration is that no tools are required to attach the latch assembly to the side panel 120 or lid 310 320.

Figure 11:
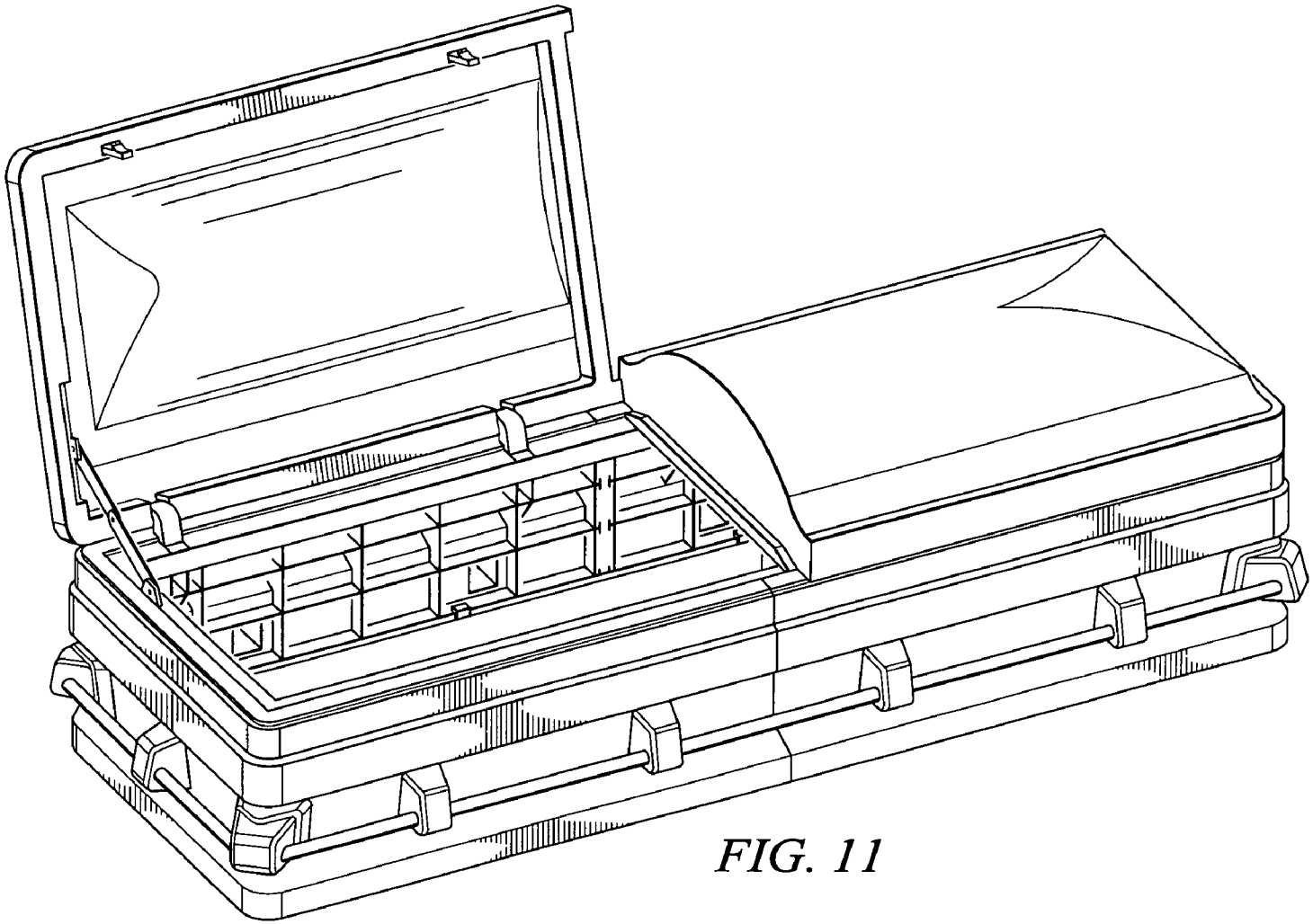
FIG. 11 is a top perspective view of the casket in accordance with one embodiment of the present invention.

FIG. 11 is a top perspective view of the casket in accordance with one embodiment of the present invention. Like traditional caskets, the present casket provides an open casket viewing option.

Figure 12:
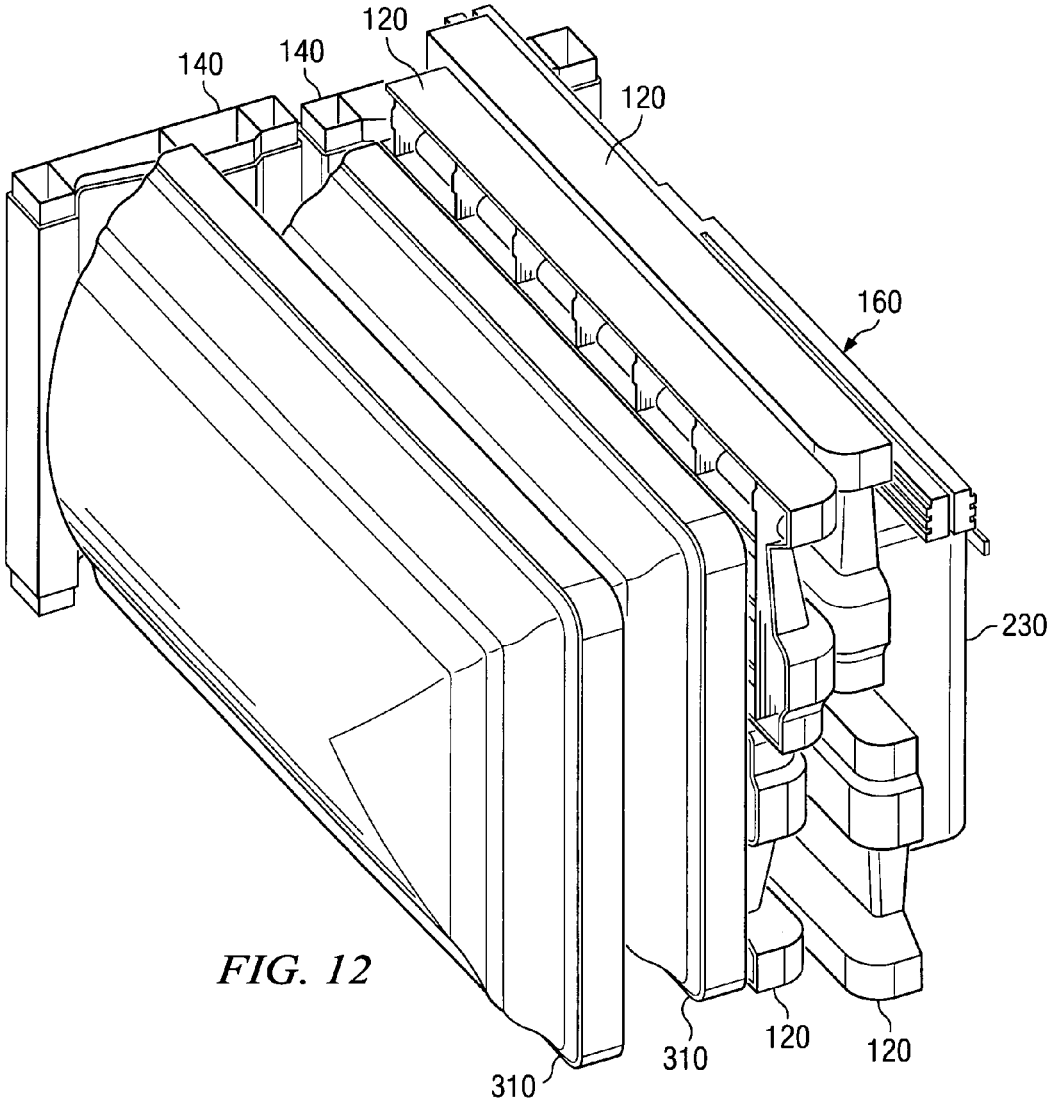
FIG. 12 is a simplified perspective view illustrating the packing configuration of the kit for making a modular casket in accordance with one embodiment of the present invention.

FIG. 12 is a simplified perspective view of illustrating the packing configuration of the kit for making a modular casket in accordance with one embodiment of the present invention. As shown in FIG. 12, the various parts of the casket can be efficiently packaged as a kit in compact form for shipment or storage until partial or full assembly is desired. In one embodiment, the lid sections 310 can be adjacent one another and alternatively nested. The side panels 120 can be can be grouped together between the lid section 310 and a base pan 230. Nested within the base pan 230 can be one or more nested base sections (not shown). Adjacent end panels 140 can be oriented perpendicular to the side panels 120 or lid 310. In one embodiment (not shown), the kit comprises two end panels, two sidewalls and a base section. It should be pointed out that the exemplary packing configuration depicted in FIG. 12 is for purposes of illustration and not for purposes of limitation. Any compact or efficient shipping configuration can be used that minimizes the storage volume required by a disassembled casket. In one embodiment, the stored or packaged volume of the casket is approximately 50% less than the assembled volume or volume of the casket when fully assembled. The disassembled casket comprising the kit for making the modular casket can then be placed into a shipping container to protect the casket from damage during shipment.

The present invention provides numerous advantages over the prior art. First, the plastic caskets of the present invention are less expensive to fabricate than the traditional wood or steel caskets. Second, the casket can be easily shipped as a more compact set of parts than a traditional wood or steel casket, or a non-modular casket fabricated from other materials. Further, because plastic is lighter than wood or metal, the casket of the present invention is not only less expensive to ship, but easier to handle, both in unassembled and assembled form. Further, the casket can be easily moved and stored.

Third, the casket of the present invention can be quickly and easily constructed and assembled by a funeral home or by an individual with little or no assembly experience. The only tools that may be required include a rubber mallet and a screwdriver. The assembly of the snap-fit and pressure-fit pieces is intuitive in the way in which the pieces are put together. Such advantages can be useful in areas of natural disasters. Such advantage also provides the ability to direct-market the casket to consumers through a phone number or web-site without the added expense of a middle man. Further, the casket can be marketed to consumers through stores by-passing the traditional funeral home and resultant mark-up.

Fourth, the casket is made of materials that is more durable than the prior art caskets. For example, unlike wood, plastic does not swell or deform. Unlike metal, plastic does not rust or dent. Further, when the casket of the present invention is packed, it can be shipped without worry of exposure to the elements. For example, the caskets and casket kits of the present invention can be stored outside with worry of exposure to the elements including, but not limited to temperature, humidity, moisture, blowing sand, etc. Such advantage can be useful in areas of natural disasters. Wood, on the other hand, must be stored in controlled climate conditions. Similarly, metal-type caskets, if subjected to high humidity or moisture conditions, are susceptible to rust, especially if any scratches were made through the painted metal during shipment. Thus, the present invention provides a casket that is more durable under both shipping and storage conditions.

Fifth, the casket can be made to emulate the caskets of wood design or steel designs. For example, a wood grain finish can be imparted into the injection molded plastic. Further, rounded corners used in wood caskets can be provided in plastic caskets of the present invention. Further, the color of the plastic can be easily changed to emulate steel-type colors. Moreover, the casket of the present invention has the same accessories as caskets of the prior art. Consequently, the present invention provides a casket having a similar look and design as prior art caskets with lower costs. Thus, there is little or no stigma attached to using a casket made from less expensive plastic materials of the present invention.

It will now be evident to those skilled in the art that there has been described herein a modular casket or coffin. The terms and expressions employed herein have been used as terms of description and not of limitation; and thus, there is no intent of excluding equivalents, but on the contrary it is intended to cover any and all equivalents that may be employed without departing from the spirit and scope of the invention.

In sum, while this invention has been particularly shown and described with reference to a preferred embodiment, it will be understood by those skilled in the art that various changes in form and detail may be made therein without departing from the spirit and scope of the invention.

We claim:

1. A kit for making a modular casket for storing a deceased therein, said kit comprising:

a plurality of wedge members;

two end panels;

a first sidewall and a second sidewall, each sidewall further comprising a first side panel having at least one alignment slot and a second side panel having at least one alignment protrusion, wherein said first side panel and said second side panel are configured to be engaged and connected by at least one of said wedge members locking each said alignment slot of said first side panel with each said alignment protrusion on said second side panel, wherein each sidewall is configured to pressure-fit to said end panels;

a base section slidably attached to each said sidewall, wherein said base section has no integrally-hinged sidewall; and wherein said end panels, said first and second sidewalls, and said base section cooperate to define a body portion of said modular casket for storing the deceased therein.

2. The kit of claim 1 wherein at least one said wedge members for connecting said first side panel and said second side panel further comprises one or more locking frames to lock said alignment slot with said alignment protrusion.

3. The kit of claim 1 wherein said base section further comprising two base ends and a middle panel.

4. The kit of claim 1 further comprising one or more hinge assemblies wherein said hinge assembly is adapted to be pressure-fit to said first sidewall.

5. The kit of claim 1 further comprising a lid for attachment to said body portion of said modular casket, and wherein said first sidewall or said second sidewall is pressure-fit to said end panel via a receiving cavity, wherein said end panel comprises said receiving cavity.

6. The kit of claim 5 wherein said lid further comprises a lid frame attached to one or more lid sections.

7. The kit of claim 6 wherein said lid frame is configured to be pressure-fit to said lid sections.

8. The kit of claim 5 further comprising a latch assembly, wherein said latch assembly comprises a clip for fastening a male latch to said lid and a female latch slidably attachable to said first sidewall or said second sidewall, wherein said latch assembly is adapted to be attached without the use of tools.

9. The kit of claim 5 further comprising a latch assembly for fasting said lid to said first sidewall or said second sidewall wherein said latch assembly is not visible when said casket is closed.

10. The kit of claim 5 wherein one or more of said end panels is rounded.

11. The kit of claim 1 further comprising a gasket disposed about an upper perimeter of said sidewalls and/or said end panels.

12. The kit of claim 11 wherein said gasket is configured to be pressure-fit to said side panels or said end panels.

13. The kit of claim 1 wherein said sidewalls are adapted to permit attachment of a handrail without the use of tools.

14. The kit of claim 13 further comprising one or more decorative handrail covers wherein one or more of said covers is adapted to be attached without the use of tools.

15. The kit of claim 1 wherein said kit comprises a packaged volume that is less than about 50% less than an assembled volume.

16. The kit of claim 1 wherein said sidewalls are further configured to be pressure-fit to said base section without the need for a screw, nut, bolt, or adhesive.

* * * * *